US008416977B1

(12) United States Patent
Axtell, III

(10) Patent No.: US 8,416,977 B1
(45) Date of Patent: Apr. 9, 2013

(54) COMBINATION HELMET AND SPEAKER SYSTEM AND METHOD

(76) Inventor: Freeman J. Axtell, III, Hemet, CA (US)

( * ) Notice: Subject to any disclaimer, the term of this patent is extended or adjusted under 35 U.S.C. 154(b) by 155 days.

(21) Appl. No.: 12/967,168

(22) Filed: Dec. 14, 2010

(51) Int. Cl.
*H04R 11/04* (2006.01)

(52) U.S. Cl.
USPC ..... 381/367; 381/376

(58) Field of Classification Search ..... 381/388, 381/376, 367
See application file for complete search history.

(56) References Cited

U.S. PATENT DOCUMENTS

| | | | | |
|---|---|---|---|---|
| 5,465,421 | A | 11/1995 | McCormick | |
| 6,546,264 | B1 | 4/2003 | Kennedy | |
| 6,970,691 | B2 | 11/2005 | Thompson | |
| 6,978,162 | B2 | 12/2005 | Russell et al. | |
| 7,974,432 | B1 * | 7/2011 | Ryan | 381/388 |
| 2004/0025230 | A1 | 2/2004 | Rainey | |
| 2005/0226451 | A1 | 10/2005 | Davis | |
| 2006/0000009 | A1 * | 1/2006 | Fleming | 2/412 |
| 2007/0226876 | A1 | 10/2007 | Foust et al. | |
| 2009/0208040 | A1 | 8/2009 | Planansky | |
| 2010/0146684 | A1 | 6/2010 | Rivas, III et al. | |

* cited by examiner

*Primary Examiner* — Davetta W Goins
*Assistant Examiner* — Amir Etesam
(74) *Attorney, Agent, or Firm* — Eric Karich

(57) ABSTRACT

A combination helmet and speaker system has an audio media player and a pair of speakers removably mounted on a helmet using locking fastening materials. First and second locking fastening materials are adapted for removably mounting the audio media player on the helmet. The pair of speakers each have an electrical connector cord that extends to a plug that is adapted to operatively engage the output port of the audio media player. Two pairs of locking fastening materials are adapted for mounting the pair of speakers on the helmet. A method of mounting the audio media player and the speakers on the helmet is also disclosed.

7 Claims, 2 Drawing Sheets

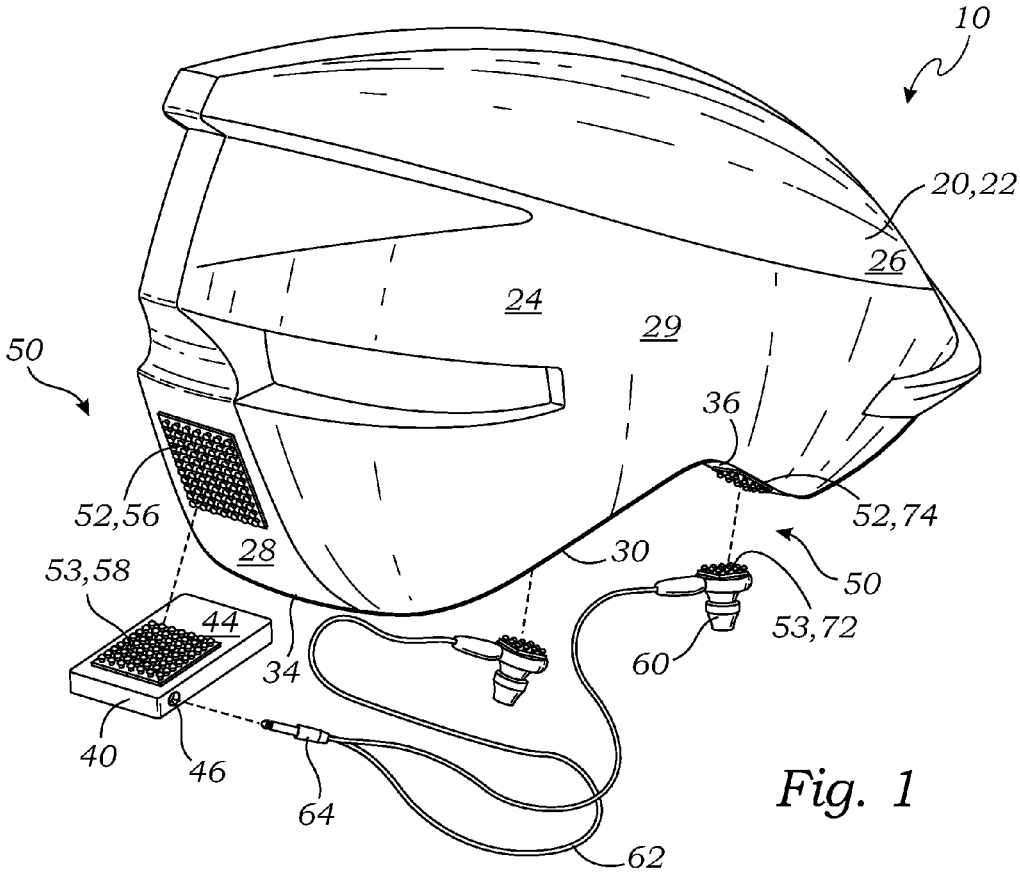
Fig. 1
Fig. 2
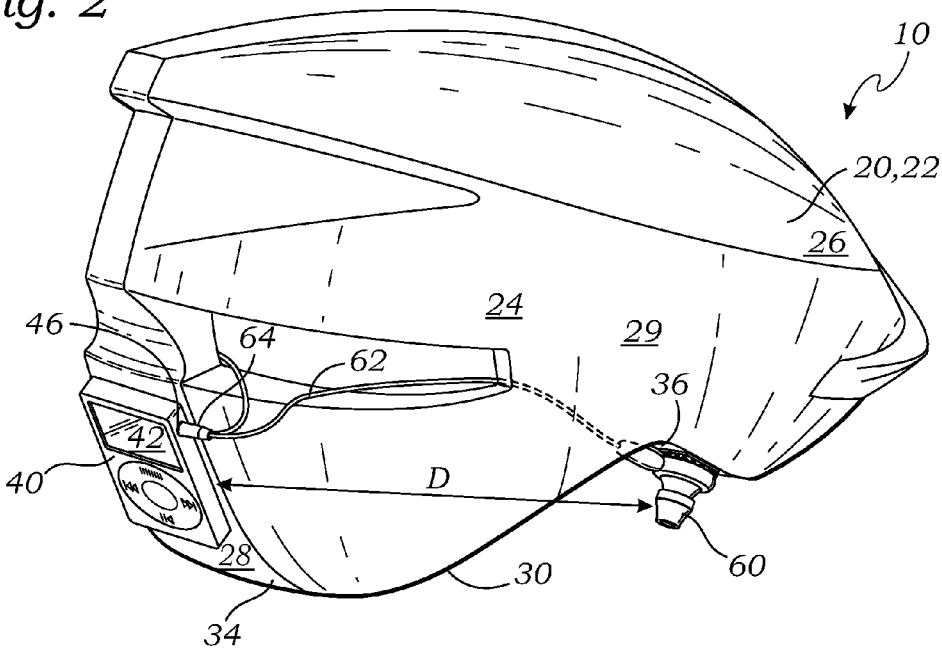

COMBINATION HELMET AND SPEAKER SYSTEM AND METHOD

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to protective head gear, and more particularly to a helmet that includes an audio media player and a pair of speakers removably mountable on the helmet with locking fastening materials.

2. Description of Related Art

Many sports activities require the wearing of protective helmets, such as bicycling, roller-skating, and similar activities. Such sports activities can be made more enjoyable if the user is able to listen to audio media such as music, audio books, and the like. Many portable audio player devices are available to enable listening to audio media while on the go, including portable radios, tape players, CD players, and MP3 players (e.g., iPod® players).

Listening to these devices may be difficult, however, when wearing a protective helmet. The prior art has therefore devised many helmet systems that enable the user to listen to audio media in conjunction with wearing a helmet.

McCormick, U.S. Pat. No. 5,465,421, for example, teaches a sports helmet with a portable audio player that includes a protective helmet shell that includes speakers built into the helmet adjacent the user's ears. Built in helmet wires extend to the back of the helmet, where a port is built into the helmet to enable an MP3 player to be plugged into the helmet via an extension electrical wire.

A similar system in disclosed in Thompson, U.S. Pat. No. 6,970,691, which teaches a similar sports helmet with built in speakers and a port located at the back of the helmet.

The problem with such systems is that the user is required to buy a specialty helmet with the electronics built in, as well as an extension wire, in order to use his or her MP3 player. This is relatively expensive, and wasteful since the user most likely already owns a helmet.

Planansky, U.S. 2009/0208040, teaches a baseball cap that is adapted to removably mount both the MP3 player and the speakers. However, this cap also requires the purchase of a specially adapted baseball cap, with suitable slots and apertures for mounting the MP3 player and speakers. The above-described references are hereby incorporated by reference in full.

The prior art teaches specialty helmets, caps, and other headgear that is specially manufactured to include or mount speakers and media players. However, the prior art does not teach the use of locking fastening materials to removably mount the audio media player and the pair of speakers on standard helmets, without the need to customize the helmet, cut holes in the cap or helmet, etc. This critical improvement enables a user to continue to use his or her existing helmet, and adapt the existing helmet to removably mount an MP3 player. The present invention fulfills these needs and provides further related advantages as described in the following summary.

SUMMARY OF THE INVENTION

The present invention teaches certain benefits in construction and use which give rise to the objectives described below.

One embodiment of the present invention provides a combination helmet and speaker system that includes an audio media player and a pair of speakers removably mounted on a helmet using locking fastening materials. The helmet has a protective shell shaped to be worn on a head of a user, the protective shell having an outer surface that forms a lower rim. The lower rim has side rim surfaces that are adapted to be positioned adjacent ears of the user when the helmet is worn by the user. The audio media player has a back surface and an output port. First and second locking fastening materials are adapted for removably mounting the audio media player on the helmet, the first locking fastening material being bonded to the outer surface of the helmet, the first locking fastening material being separated from each of the side rim surfaces by a distance. The second locking fastening material is bonded to the back surface of the audio media player. The second locking fastening material is adapted to removably interlock with the first locking fastening material for removably mounting the audio media player onto the helmet. The pair of speakers each have an electrical connector cord that extends to a plug that is adapted to operatively engage the output port of the audio media player. Each electrical connector cord has a length that is approximately equal to the distance between the first locking fastening material and one of the side rim surfaces. Two pairs of locking fastening materials are adapted for mounting the pair of speakers on the helmet. Each of the two pairs has a first speaker locking fastening material bonded to each of the pair of speakers, and a second helmet locking fastening material bonded to one of the side rim surfaces of the helmet, so that the pair of speakers can be removably mounted on the side rim surfaces of the helmet adjacent the ears of the user.

Another embodiment of the invention includes a method for mounting an audio media player on a helmet. The method comprises the steps of: providing locking fastening materials, each having first and second interlocking elements that each include a plurality of mushroom shaped elements that can interlock to securely but removably join the first and second interlocking elements together; providing a pair of speakers each having an electrical connector cord that extends to a plug; bonding the first interlocking elements of the locking fastening materials to the outer surface of the helmet, and to the side rim surfaces of the helmet; bonding the second interlocking fastening elements of the locking fastening materials to the back surface of the audio media player, and to each of the pair of speakers; removably mounting the pair of speakers to the side rim surfaces adjacent the ears of the user by removably interlocking the locking fastening materials; operatively engaging the plug of the electrical connector cord of the pair of speakers with the output port of the audio media player; and removably mounting the audio media player onto the helmet by removably interlocking the locking fastening materials.

A primary objective of the present invention is to provide a combination helmet and speaker system, and method of mounting speakers on a helmet, having advantages not taught by the prior art.

Another objective is to provide a method of mounting speakers on a standard helmet using locking fastening materials to form the combination, without the need to customize the helmet, cut holes in the cap or helmet, or otherwise modify the helmet.

Another objective is to provide a method of mounting the speakers on the helmet using locking fastening materials that interlock with sufficient locking strength so that the audio media player does not fall off the helmet during use.

A further objective is to provide a method of mounting the audio media player and the speakers in particular locations, using a special length of electrical connector cord, that enables the audio media player to be mounted without excess cord hanging out of the helmet in a potentially dangerous manner.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings:

FIG. 1 is a rear perspective exploded view of a combination helmet and speaker system according to one embodiment of the present invention, FIG. 2 is a rear perspective view thereof once the combination has been assembled;

DETAILED DESCRIPTION OF THE INVENTION

The above-described drawing figures illustrate the invention, a combination helmet and speaker system 10 that enables a user can listen to music while wearing a helmet 20 (e.g., while biking, or other such activity).

Figure 3:
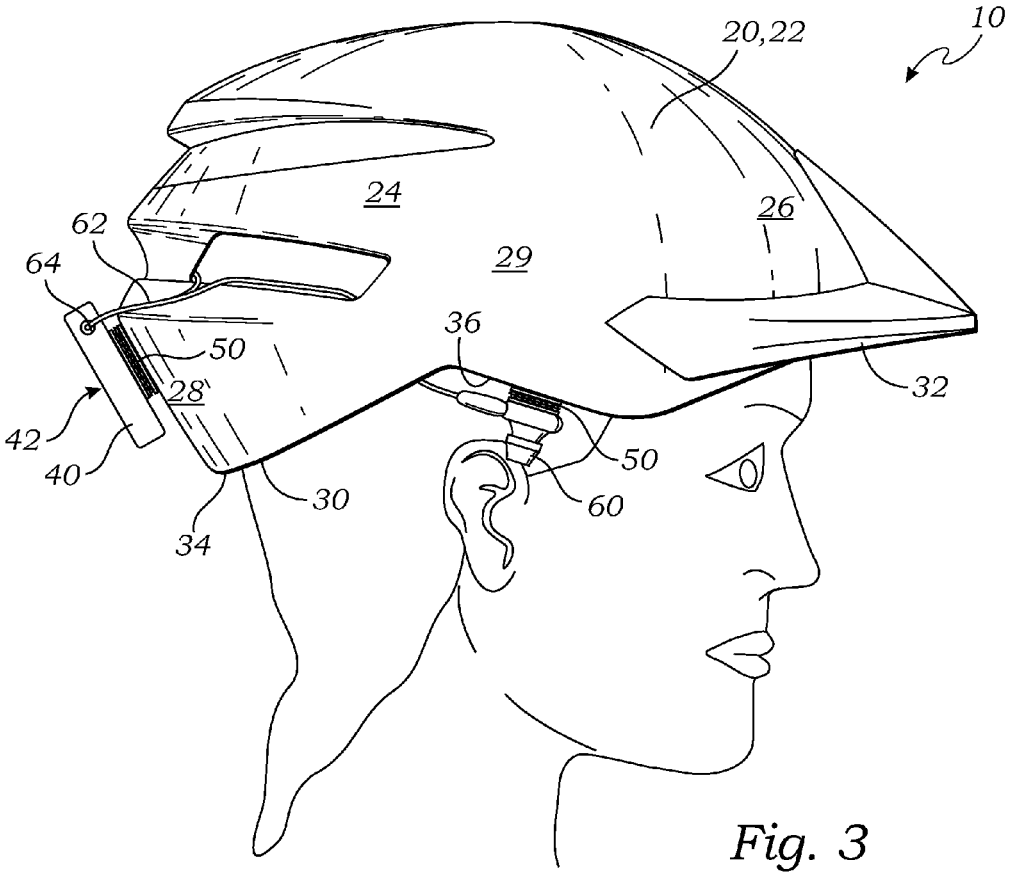
FIG. 3 is a side elevational view thereof, illustrating the combination being worn by a user.
Figure 4:
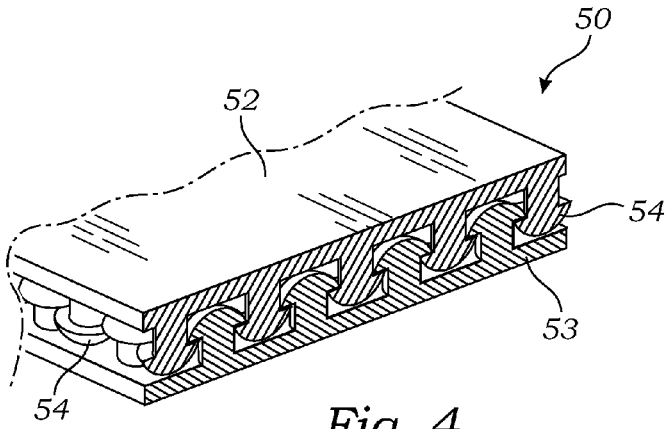
FIG. 4 is a perspective view of locking fastening materials used in the combination.

FIG. 1 is a rear perspective exploded view of the combination 10 according to one embodiment of the present invention. FIG. 2 is a rear perspective view thereof once the combination 10 has been assembled. FIG. 3 is a side elevational view thereof, illustrating the combination 10 being worn by a user. FIG. 4 is a perspective view of locking fastening materials 50 used in the combination 10.

As shown in FIGS. 1-4, the combination 10 includes a helmet 20, an audio media player 40, and a pair of speakers 60. The combination 10 also includes locking fastening materials 50, described below in greater detail below, for attaching the audio media player 40 and the pair of speakers 60 to the helmet 20. Importantly, the helmet 20 does not have to be modified or specially manufactured (e.g., with special slits, flaps, or other modifications), beyond attachment of the locking fastening materials 50. Any standard helmet may be used.

The helmet 20 is a standard safety helmet that is well known in the art. The helmet 20 includes a protective shell 22 shaped to be worn on a head of the user and adapted to absorb impact in the event of an accident. The protective shell 22 has an outer surface 24 that forms a lower rim 30 shaped to receive the head of the user. The outer surface 24 includes opposing front and rear surfaces 26 and 28, and opposed side surfaces 29. The lower rim 30 includes front, rear, and side rim surfaces 32, 34, and 36. The side rim surfaces 36 are adapted to be positioned adjacent the ears of the user when the helmet 20 is worn.

The audio media player 40 is a standard electronic device that is capable of playing audio media files (e.g., MP3 player or similar portable electronic device). The audio media player 40 has opposed front and back surfaces 42 and 44, and an output port 46 for outputting the audio (e.g., music, audio books, etc.) to the pair of speakers 60. Since audio media players are well known in the art, they are not discussed in greater detail herein.

The locking fastening materials 50 are used to removably mount the audio media player 40 and the pair of speakers 60 onto the helmet 20. The term "locking fastening materials" is hereby defined to include two part snapping and locking materials that include a plurality of mushroom shaped heads 54, illustrated in FIG. 4, that make an audible snap as the two components snap and interlock together. Commercial products that are suitable include DUAL LOCK™ products sold by 3M Corporation, and equivalent products. It expressly excludes hook and loop fasteners, which are not acceptable as fasteners in this instance because of their low holding strength.

In one embodiment, each of the locking fastening materials 50 includes first and second interlocking elements 52 and 53 that each include the plurality of mushroom shaped elements 54 that can interlock to securely but removably join the first and second interlocking elements 52 and 53 together. The mushroom shaped elements 54 may snap together with an audible snapping sound when engaged, to confirm to the user that the two are completely engaged. In general, three pieces of the locking fastening materials 50 are used to removably mount the audio media player 40 and the speakers 60. The detailed construction of one embodiment is discussed in greater detail below.

In one embodiment, as illustrated in FIG. 1, the locking fastening materials 50 include first and second locking fastening materials 56 and 58 adapted for removably mounting the audio media player 40 on the helmet 20. In this embodiment, the first locking fastening material 56 is adapted to be bonded to the outer surface 24 of the helmet 20 (e.g., a suitable adhesive bonding backing, as is well known in the art). The first locking fastening material 56 is positioned on the helmet 20 such that it is separated from each of the side rim surfaces 36 by a distance D, as illustrated in FIG. 2. In the embodiment illustrated in FIGS. 1-4, the first locking fastening material 56 is bonded to the rear surface 28 of the outer surface 24 of the helmet 20, in a location that is equidistant from each of the side rim surfaces 36. In alternative embodiments, the first locking fastening material 56 might be placed elsewhere on the helmet 20, as long as the spacing is appropriate, as discussed in greater detail below.

In the embodiment illustrated in FIGS. 1-4, the second locking fastening material 58 is adapted to be bonded to the back surface 44 of the audio media player 40. Once bonded in place, the second locking fastening material 58 is adapted to removably interlock with the first locking fastening material 56 for removably mounting the audio media player 40 onto the helmet 20.

The pair of speakers 60 each have an electrical connector cord 62 that extends to a plug 64 that is adapted to operatively engage the output port 46 of the audio media player 40. Each electrical connector cord 62 may have a length that is approximately equal to the distance D between the first locking fastening material 56 and one of the side rim surfaces 36. In other words, the length is preferably at least enough to reach the side rim surface 36, but not of sufficiently greater length to create an unacceptably large amount of excess that may tangle or catch on passing objects.

The locking fastening materials 50 may further include two pairs of locking fastening materials 70 adapted for mounting the pair of speakers 60 on the helmet 20. Each of the two pairs 70 may have a first speaker locking fastening material 72 bonded to each of the pair of speakers 60, and a second helmet locking fastening material 74 bonded to one of the side rim surfaces 36 of the helmet 20, so that the pair of speakers 60 can be removably mounted on the side rim surfaces 36 of the helmet 20 adjacent the ears of the user.

As illustrated in FIG. 2, the audio media player 40 can therefore be removably mounted on the outer surface 24 of the helmet 20, the pair of speakers 60 can be removably engaged with the audio media player 40 via the electrical connector cord 62, and the pair of speakers 60 can be removably mounted to the side rim surfaces 36 adjacent the ears of the user, so that the user can listen to music from the audio media player 40 while wearing the helmet 20.

The invention further includes a method for mounting the audio media player 40 on the helmet 20 using the locking fastening materials 50, as described above. The locking fastening materials 50 described above, or an equivalent arrangement, is provided, for mounting the audio media player 40 and speakers 60, as described above.

The first interlocking elements 52 of the locking fastening materials 50 are bonded to the outer surface 24 of the helmet 20, and to the side rim surfaces 36 of the helmet 20. The second interlocking fastening elements 53 of the locking fastening materials 50 are bonded to the back surface 44 of the audio media player 40, and to each of the pair of speakers 60. The pair of speakers 60 may then be removably mounted to the side rim surfaces 36 adjacent the ears of the user by removably interlocking the locking fastening materials 50. The audio media player 40 may then be removably mounted onto the helmet 20 by removably interlocking the locking fastening materials 50.

Once assembled, whenever the user wants to listen to music, the plug 64 of the electrical connector cord 62 of the pair of speakers 60 may then be operatively engaged with the output port 46 of the audio media player 40. Once the user has finished wearing the helmet 20, the audio media player 40 may be disconnected from the plug 64, and detached from the helmet 20, and taken with the user. This enables the user to continue to listen to the audio media player 40. It also keeps the audio media player 40 safe from theft, in the event that the helmet 20 is left in a public place.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination helmet and speaker system adapted to be worn on a head of a user, adjacent ears of the user, so that the user can listen to the combination without hearing impairment, the combination comprising:

a helmet having a protective shell shaped to be worn on the head of the user, the protective shell having an outer surface that forms a lower rim, the lower rim having side rim surfaces that are adapted to be positioned adjacent the ears of the user when the helmet is worn by the user;

an audio media player having a back surface and an output port;

first and second locking fastening materials for removably mounting the audio media player on the helmet, the first locking fastening material being bonded to the outer surface of the helmet, the first locking fastening material being separated from each of the side rim surfaces by a distance, and the second locking fastening material being bonded to the back surface of the audio media player, the second locking fastening material removably interlocking with the first locking fastening material for removably mounting the audio media player onto the helmet;

a pair of speakers each having an electrical connector cord that extends to a plug that is adapted to operatively engage the output port of the audio media player, each electrical connector cord having a length that is approximately equal to the distance between the first locking fastening material and one of the side rim surfaces;

two pairs of locking fastening materials for mounting the pair of speakers on the helmet, each of the two pairs having a first speaker locking fastening material bonded to each of the pair of speakers, and a second helmet locking fastening material bonded to one of the side rim surfaces of the helmet, so that the pair of speakers can be removably mounted on the side rim surfaces of the helmet adjacent the ears of the user; and whereby the audio media player can be removably mounted on the outer surface of the helmet, the pair of speakers can be removably engaged with the audio media player via the electrical connector cord, and the pair of speakers can be removably mounted to the side rim surfaces adjacent the ears of the user, so that the user can listen to music from the audio media player, and wherein each of the pair of speakers is attached directly to the helmet via one of the two pairs of locking fastening materials in a manner that leaves the ears of the user completely uncovered, by either the speakers or the helmet, thus leaving the user's hearing unimpaired during use.

2. The combination of claim 1, wherein the first locking fastening material is bonded to a rear surface of the outer surface of the helmet, in a location that is equidistant from each of the side rim surfaces.

3. The combination of claim 1, wherein the locking fastening materials each include first and second interlocking elements that each include a plurality of mushroom shaped elements that can interlock to securely but removably join the first and second interlocking elements together.

4. A method for mounting an audio media player on a helmet, the audio media player having a back surface and an output port, and the helmet having a protective shell having an outer surface that form side rim surfaces, the method comprising the steps of:

providing locking fastening materials, each having first and second interlocking elements that each include a plurality of mushroom shaped elements that can interlock to securely but removably join the first and second interlocking elements together;

providing a pair of speakers each having an electrical connector cord that extends to a plug;

bonding the first interlocking elements of the locking fastening materials to the outer surface of the helmet, and to the side rim surfaces of the helmet;

bonding the second interlocking fastening elements of the locking fastening materials to the back surface of the audio media player, and to each of the pair of speakers;

removably mounting the pair of speakers to the side rim surfaces adjacent the ears of the user by removably interlocking the locking fastening materials;

operatively engaging the plug of the electrical connector cord of the pair of speakers with the output port of the audio media player; and removably mounting the audio media player onto the helmet by removably interlocking the locking fastening materials, wherein each of the pair of speakers is attached directly to the helmet via one of the two pairs of locking fastening materials in a manner that leaves the ears of the user completely uncovered, by either the speakers or the helmet, thus leaving the user's hearing unimpaired during use.

5. A method for mounting an audio media player on a helmet, the audio media player having a back surface and an output port, and the helmet having a protective shell having an outer surface that form side rim surfaces, the method comprising the steps of:

providing first and second locking fastening materials;

bonding the first locking fastening material to the outer surface of the helmet such that the first locking fastening material is separated from each of the side rim surfaces by a distance;

bonding the second locking fastening material to the back surface of the audio media player;

providing a pair of speakers each having an electrical connector cord that extends to a plug, each electrical connector cord having a length that is approximately equal to the distance between the first locking fastening material and one of the side rim surfaces;

providing two pairs of locking fastening materials for mounting the pair of speakers on the helmet, each of the two pairs having a first speaker locking fastening material and a second helmet locking fastening material;

bonding the first speaker locking fastening material of each of the two pairs of locking fastening material to one of the pair of speakers;

bonding the second helmet locking fastening material of each of the two pairs of locking fastening material to one of the side rim surfaces of the helmet;

removably mounting the pair of speakers to the side rim surfaces adjacent the ears of the user by removably engaging the first speaker locking fastening material of each of the pair of speakers with the second helmet locking fastening material of each of the side rim surfaces;

operatively engaging the plug of the electrical connector cord of the pair of speakers with the output port of the audio media player; and removably mounting the audio media player onto the helmet by removably interlocking the second locking fastening material of the audio media player with the first locking fastening material of the helmet, wherein each of the pair of speakers is attached directly to the helmet via one of the two pairs of locking fastening materials in a manner that leaves the ears of the user completely uncovered, by either the speakers or the helmet, thus leaving the user's hearing unimpaired during use.

6. The method of claim 5, wherein the first locking fastening material is bonded to a rear surface of the outer surface of the helmet, in a location that is equidistant from each of the side rim surfaces.

7. The method of claim 5, wherein the locking fastening materials each include first and second interlocking elements that each include a plurality of mushroom shaped elements that can interlock to securely but removably join the first and second interlocking elements together.

* * * * *